United States Patent [19]

Yasunaga

[11] Patent Number: 4,921,364

[45] Date of Patent: May 1, 1990

[54] DOT MATRIX PRINT HEAD HAVING EASILY REMOVABLE MAGNETS

[75] Inventor: Makoto Yasunaga, Kawagoe, Japan

[73] Assignee: Citizen Watch Co., Ltd., Tokyo, Japan

[21] Appl. No.: 240,431

[22] Filed: Sep. 1, 1988

[30] Foreign Application Priority Data

Sep. 10, 1985 [JP] Japan ..... 60-201339

[51] Int. Cl.[5] ..... B41J 3/12

[52] U.S. Cl. ..... 400/124; 101/93.05; 400/157.2

[58] Field of Search ..... 400/124, 121, 157.1, 400/157.2; 101/93.05, 93.04, 93.29, 93.34, 93.48; 335/229, 230, 232

[56] References Cited

U.S. PATENT DOCUMENTS

| | | | |
|---|---|---|---|
| 4,167,343 | 9/1979 | Golobay | 400/124 |
| 4,225,250 | 9/1980 | Wagner et al. | 400/124 |
| 4,539,905 | 9/1985 | Zenner | 400/124 |

FOREIGN PATENT DOCUMENTS

| | | | |
|---|---|---|---|
| 63283 | 5/1980 | Japan | 400/124 |
| 27365 | 3/1981 | Japan | 400/124 |
| 42665 | 4/1981 | Japan | 400/124 |
| 44674 | 4/1981 | Japan | 400/124 |
| 49279 | 5/1981 | Japan | 400/124 |
| 86770 | 7/1981 | Japan | 400/124 |
| 173173 | 10/1982 | Japan | 400/124 |
| 194574 | 11/1983 | Japan | 400/124 |
| 98867 | 6/1984 | Japan | 400/124 |
| 156760 | 9/1984 | Japan | 400/124 |
| 168663 | 9/1985 | Japan | 400/124 |
| 176776 | 9/1985 | Japan | 400/124 |

*Primary Examiner*—David A. Wiecking
*Attorney, Agent, or Firm*—Koda & Androlia

[57] ABSTRACT

A printing head for a dot matrix printer is disclosed which facilitates assembly and disassembly and improves printing quality.

The printing head has a plurality of hammers carrying respective printing wires, a plurality of coils each of which corresponds to each of the hammers, and a permanent magnet for retaining the hammers at the standing positions thereof, so that the magnetic flux of the permanent magnet is cancelled by exciting the coils so as to release the hammers, thereby driving the printing wires by virtue of the elasticity of the hammers. The printing head includes an annular base which is provided with, at the outer portion thereof, a hammer mounting portion for securing a plurality of hammer base portions, at the inner portion thereof, a plurality of implanted columnar cores around which respective coils are wound, and a short-circuiting portion which constitutes the closed magnetic circuits of the respective coils in cooperation with respective hammers. The permanent magnet is attached to the outside of the short-circuiting portion and the hammer mounting portions at the outer periphery of the base. The printing head is sub-assembled before the attachment of the permanent magnet.

8 Claims, 4 Drawing Sheets

DOT MATRIX PRINT HEAD HAVING EASILY REMOVABLE MAGNETS

This is a continuation of application Ser. No. 900,494, filed Aug. 26, 1986, now abandoned.

BACKGROUND OF THE INVENTION

1. Field of the Invention

The present invention relates to a printing head for dot matrix printers and, more particularly, to the structure of an improved printing head which is capable of being assembled and disassembled with facility.

2. Description of the Prior Art

Dot matrix printers which protrude a plurality of printing wires toward recording paper in accordance with printing information so as to form desired characters symbols, etc., by a plurality of dots are known and used as output devices for various information apparatus.

In a printing head of such a dot matrix printer, a plurality of printing wires are ordinarily so arranged that the tips thereof are situated on the circumference of a circle or a circumference of concentric circles. During printing, every time the position of a character is reached, a desired number of printing wires are operated so as to constitute dots, and a group of these dots form the character.

Such a type of conventional printing head (U.S. Pat. No. 4,225,250) for dot matrix printers is shown in FIGS. 4 to 6.

This printing head has a cylindrical sandwich structure, and is composed of a base plate 10, a ring magnet 12, a hammer disc 14, a face plate 16, column members 18 and coils 20 wound around the column members 18.

The ring magnet 12 is a permanent magnet which is attached to the base plate 10, and the magnetic field thereof is divided into magnetized portions 22 and non-magnetized portions 24 at axially regular intervals. Holes 40 for attaching the ring magnet 12 are made in each of the non-magnetized portions 24. The base plate 10 is provided with a plurality of tapped holes 26 for receiving respective column members 18, as shown in FIGS. 5 and 6.

The column member 18 is made of, for example, permeable material, and the length thereof is substantially equal to the thickness of the ring magnet. The coil 20 is wound around each of the column member 18.

The hammer disc 14 is attached to the ring magnet 12 through spacers 28 and 30 of a permeable material. The hammer disc 14 is made of an elastic permeable material and is provided with a plurality of hammers 32 at regular intervals in the radially inward direction of the disc 14. The number of the hammers 32 is equal to the number of the magnetized portions 22 of the ring magnet 12. The free ends of the hammers 32 carry printing wires 34-1, 34-2, . . . .

When assembling such a printing head, the coil 20 is first wound around the column member 18, which is screwed into the base plate 10. The base plate 10, the ring magnet 12, the spacer 28, the hammer disc 14, the spacer 30, and the face plate 16 are laid with one on top of another in that order, and bolts 36 are inserted in this state so as to be bolted in the threaded holes 38 provided on the peripheral portion of the base plate 10.

The above-described structure enables a small-sized printing head to be provided with inexpensive manufacturing cost.

Such a conventional printing head, however, has some problems. For example, when the printing head is to be disassembled, removal of the hammer disc is difficult, and the printing quality is deteriorated by magnetic interference.

Since the printing head adopts the integral type of ring magnet 12, when parts must be removed because of defect of a part, etc. after the completion of assembly, the strong magnetic force makes it difficult to separate the part from the ring magnet 12, and since the hammer disc 14 and the like are fixed to the ring magnet 12, the ring magnet 12 cannot be removed without disassembling all the parts.

Removal of parts when the magnetic force exists involves a risk of damaging a leaf spring and the like which requires accuracy.

In addition, since the magnetic path of the coil 20 does not constitute a closed magnetic circuit, excitation of the coil 20 produces magnetic interference. Therefore, if a single printing wire is driven, the magnetic flux of the coil 20 can pass through magnetic paths constituted by other hammers, cores and the like, but when a plurality of printing wires are driven, the number of magnetic paths through which the magnetic flux can pass becomes smaller, so that the magnetic flux of the coil 20 is unlikely to pass the magnetic paths. As a result, the printing pressure is greatly different between when a single printing wire is driven and when a plurality of printing wires are driven, which leads to non-uniformity of printing density.

SUMMARY OF THE INVENTION

Accordingly, it is an object of the present invention to solve the above-described problems in the prior art and to provide a printing head for dot matrix printers which is capable of being easily assembled and disassembled and is capable of improving the printing quality.

To achieve this aim, a printing head for dot matrix printers according to the present invention is composed of a plurality of hammers each of which carries a printing wire; a plurality of coils corresponding to respective hammers; and a permanent magnet for retaining the hammers in the standing positions, and is so designed that the magnetic field of the permanent magnet is cancelled by exciting the coils so as to release the hammers and drive the printing wires by virtue of the elasticity of the hammers.

The printing head includes an annular base and a permanent magnet which is attached to the outer periphery of the base. The base is provided with, at the outer portion thereof, a hammer mounting portion for securing a plurality of hammer base portions, at the inner portion thereof, a plurality of implanted columnar cores around which respective coils are wound, and a short-circuiting portion which constitutes the closed magnetic circuits of respective coils in cooperation with respective hammers.

The present invention is characterized in that the permanent magnet is attached to the outside of the short-circuiting portion and the hammer mounting portions at the outer periphery of the base, and in that the printing head is sub-assembled before the attachment of the permanent magnet.

The permanent magnet is divided into a plurality of members so that it is possible to remove each member of the permanent magnet with ease as occasion demands, thereby enabling each part to be replaced in the state in which no magnetic force exists. For the same reason, it is possible to easily vary the size of the yoke and permanent magnet for the purpose of making the attracting forces of the hammers uniform, so that the adjustment of the magnetic force is facilitated.

Since the short-circuiting portion of the base constitutes the closed magnetic circuits of the coils in cooperation with the hammers, magnetic influence during driving a plurality of printing wires is reduced and, hence, difference in printing pressure between when driving a plurality of printing wires and when driving a single printing wire is reduced. Consequently, the printing pressure is made uniform, so that it is possible to set the spring constant and the magnetic force at their maximum values, thereby enabling the printing quality to be improved and power consumption to be reduced.

The above and other objects, features and advantages of the present invention will become clear from the following description of the preferred embodiments thereof, taken in conjunction with the accompanying drawings.

DESCRIPTION OF THE PREFERRED EMBODIMENTS

Preferred embodiment of the present invention will be explained hereinunder with reference to accompanying drawings.

Figure 1:
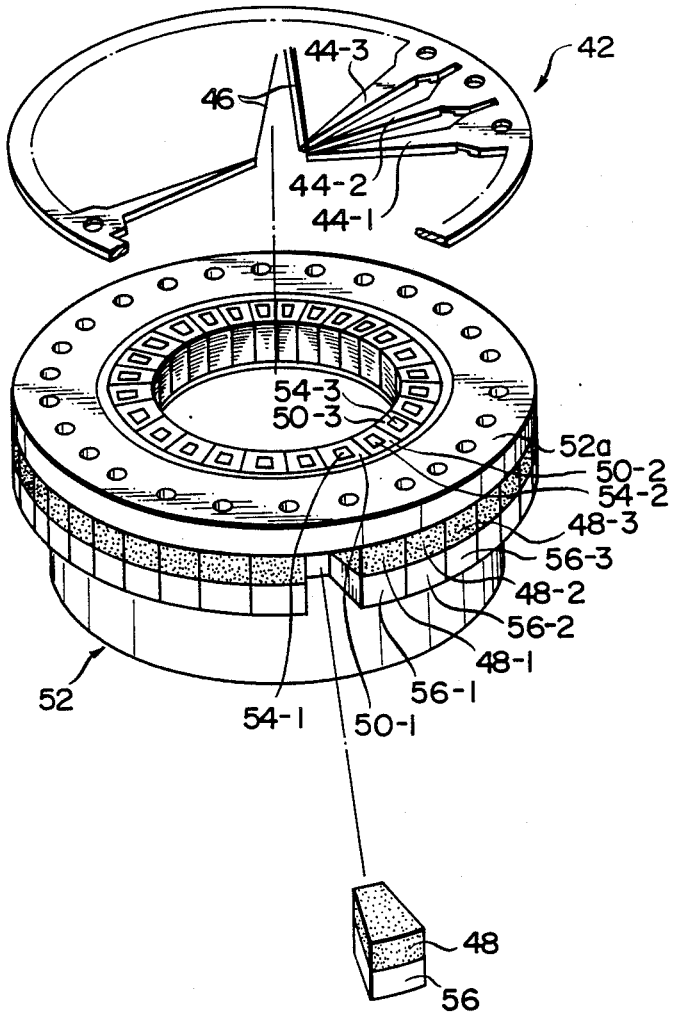
FIG. 1 is a schematic perspective view of an embodiment of a printing head for dot matrix printers according to the present invention.

FIG. 1 shows a schematic perspective view of a printing head for dot matrix printers according to the present invention.

The printing head of this embodiment is provided with a plurality of hammers 44-1, 44-2, 44-3 . . . integrally provided on a hammer disc 42 in the radially inward direction thereof. At the free ends of the hammers 44, printing wires 46 are carried.

These hammers 44-1, 44-2, 44-3 . . . are converged in the vicinity of the center of the hammer disc 42 and are so designed that the hammers 44 can move independently of each other.

Permanent magnet members 48-1, 48-2, 48-3 . . . and coils 50-1, 50-2, . . . are provided such that they correspond to respective hammers 44-1, 44-2, . . . .

When the coil 50 is excited, the magnetic field of the permanent magnet 48 is cancelled, and the attracted state of the hammer 44 is released, so that the printing wire 46 is driven by virtue of it own elasticity. In this case, the potential energy of the hammer 44 is converted into the kinetic energy which performs dot matrix printing. On the other hand, when the excitation of the coil 50 is released, the hammer 44 is attracted again to a later-described core surface by the corresponding permanent magnet 40.

The present invention is characterized in that an annular base 52 is provided which has a hammer mounting portion **52*a* at the outer portion thereof, a plurality of implanted cores 54-1, 54-2, 54-3 . . . at the inner portion thereof, and a short-circuiting portion 52*b* in close proximity to the hammer mounting portion 52*a*, and in that the permanent magnet 48 is attached to the outside of the short-circuiting portion 52*b* and the hammer mounting portion 52*a* at the outer periphery of the base 52**.

Figure 2:
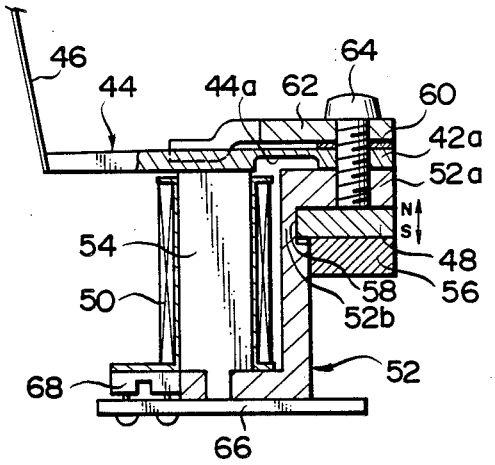
FIG. 2 is a radial sectional view of half part of the printing head shown in FIG. 1.

As shown in FIG. 2, the magnetic circuit of the magnetic flux is composed of the core 54 with the coil 50 wound therearound, the short-circuiting portion **52*b* of the base 52, the mounting portion 52*a*, a hammer base portion 42*a*, a spacer 60, a cover 62 and the hammer 44. The base 52 has the flange-shaped hammer mounting portion 52*a* for fixing the hammer base portion 42*a* of the hammer disc 42 at its outer portion, and the columnar cores 54-1, 54-2, 54-3 . . . around which the coils 50-1, 50-2, . . . are wound are implanted at the inner portion of the base 52**.

The hammer mounting portion **52*a* and the upper surface of the core 54 are made substantially flush with each other, and the location of the upper surface of the core 54 is set so that when the hammer 44 is released from the state in which it is attracted to the upper surface of the core 54, the hammer is driven with respect to the mounting surface of the hammer disc 42 by predetermined energy due to the elasticity of the hammer 44. In order to keep this elasticity, the hammer 44 has an elasticity holding portion 44*a*** having a small cross section at its fixed end.

The polarity of each permanent magnet 48 which corresponds to each hammer 44 is in the same direction as the axis of the core 54, and the magnetic force of the permanent magnet 48 is strong enough to attract the hammer 44 in resistance to its elasticity.

When the corresponding coil 50 is excited so as to cancel the magnetic flux produced by the corresponding permanent magnet 48 , the hammer 44 is released from the attracted state.

The short-circuiting portion **52*b* of the base 52 constitutes the closed magnetic circuits of the respective coils 50-1, 50-2, . . . in cooperation with the respective hammers 44-1, 44-2, . . . , and is made such as to have a locally smaller cross section. The permanent magnetic members 48-1, 48-2 which are magnetized in the axial direction of the core 54 are mounted on the outside of the short-circuiting portions 52*b* and the hammer mounting portion 52*a*** by the magnetic force.

The permanent magnet 48 is divided into the same number as that of the hammers 44-1, 44-2, 44-3 . . . or a number which is an integer multiple of the number of the hammers 44-1, 44-2, and the yoke 56 which is divided into yokes 56-1, 56-2, 56-3 . . . of approximately the same configuration as that of the respective magnetic members 48-1, 48-2, . . . are attracted to the corresponding magnetic members 48-1, 48-2, . . . .

In order to assemble such a printing head, the coils 50-1, 50-2, . . . are first wound around the corresponding cores 54-1, 54-2, . . . , and these cores 54 are implanted on the base 52 with the lead wires of the respective coils 50-1, 50-2, . . . connected to the supply terminals 68 of a printed board 66 which is attached to one end surface of the base 52 (see FIG. 2).

The hammer disc 42, the spacer 60 and the cover 62 are next laid on the hammer mounting portion **52*a* in that order, and they are fastened by a bolt 64**, whereby the sub-assembly of the printing head is completed.

The permanent magnetic members 48-1, 48-2, . . . are then attached to the outer periphery of the base 52 while they are in the state in which the yokes 56-1, 56-2, . . . are attracted to the corresponding members 48-1, 48-2, . . . .

As described above, in this embodiment, since the short circuiting portion 52*b* of the base 52 constitutes the closed magnetic fields of the coils, the magnetic resistance of the magnetic path which is produced by the excitation of the coil 50 is reduced, and the inductance of the coil is therefore increased. As a result, the rate of increase in current value for a predetermined period of energizing time and, hence, the power consumption is reduced.

Therefore, the calorific power of the coil is reduced, and the printing duty is enhanced. Small capacity for the power source suffices, thereby enabling miniaturization of the apparatus.

Furthermore, since the hammer disc 42 is attached directly to the base 52 in this embodiment, it is unnecessary to fasten or adhere the permanent magnet 48 to the base 52. This fact dispenses dispenses with the need for making holes in the permanent magnet 48, which process is very difficult, and is free from the fear of the adhered permanent magnet peeling off the base due to the rise of temperature or other accidents.

In order to improve the printing quality, it is necessary to make the preload of the hammers due to the magnetic force as uniform as possible so as to prevent the inequality of speeds of the hammers which would cause the deviation of the printing position or non-uniformity of printing density. Adjustment of the preload is facilitated in this embodiment by varying the magnetic circuits.

It is easy to vary the magnetic fields by, for example, varying the sizes of the yokes 56-1, 56-2, 56-3, . . . and the permanent magnetic members 48-1, 48-2, . . . from each other, varying the magnetized states of the magnetic members 48-1, 48-2, . . . from each other, or inserting a non-magnetic spacer between the permanent magnet 48 and a magnet mounting portion 58.

It is sometimes necessary to disassemble and assemble again the printing head after it is magnetized. For example, it may not stand a printing test in the succeeding manufacturing process, or it may become out of order with aging, so that replacement of parts such as the hammers 44 and coils 50 is required.

In such case, in a conventional printing head, assembly is out of control in a magnetized state and is so difficult that there is no alternative but to dispose the total part of the printing head. Even if a part is replaced, in the case of replacing a coil assembly, the permanent magnet which is high in cost ratio must also be disposed, which also leads to an increase in cost.

In contrast, according to the present invention, since the permanent magnet is attracted to the base 52 while it is in the state of being divided into a plurality of magnetic members, it is easy to remove the permanent magnet 48 and it is possible to disassemble and assemble without damaging parts in a state in which no magnetic force exists after the removal of the permanent magnet 48, so that yield is enhanced.

In addition, although the upper surface of the core is ground in most cases in a conventional printing head in order to flush the hammer mounting surface with the upper surface of the core, since the core 54 is implanted to the inside of the base 50 in this embodiment, there is no accumulated dimensional errors between the cores 54 and the mounting surface for hammers 44, thereby reducing the number of grinding steps.

Figure 3:
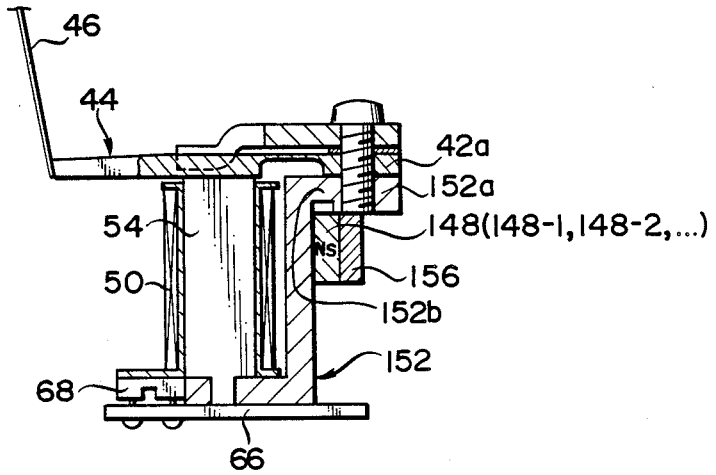
FIG. 3 is a radial sectional view of half part of another embodiment of a printing head according to the present invention.
Figure 4:
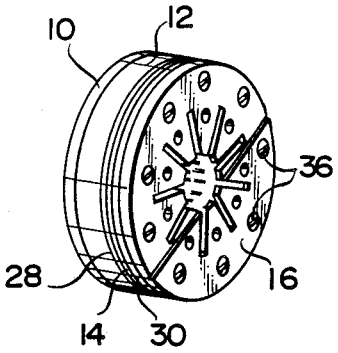
FIG. 4 PRIOR ART
FIG. 4 is an external perspective view of a conventional printing head for dot matrix printers.
Figure 5:
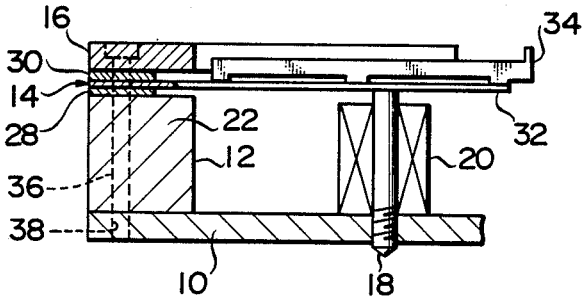
FIG. 5 PRIOR ART
FIG. 5 is a radial sectional view of half part of the conventional printing head shown in FIG. 4.
Figure 6:
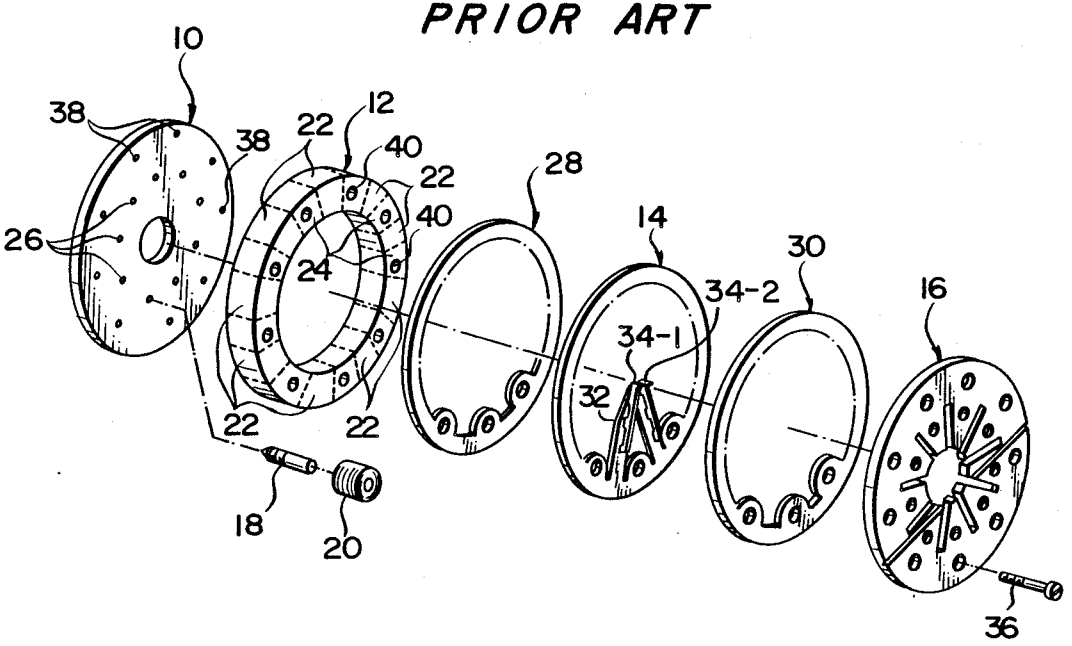
FIG. 6 PRIOR ART
FIG. 6 is an exploded perspective view of the printing head shown in FIG. 4.

FIG. 3 shows another embodiment of the present invention. This embodiment is different from the embodiment shown in FIG. 2 only in that permanent magnet 148 which is divided into permanent magnet members 148-1, 148-2, . . . which are magnetized in the direction orthogonal to the axes of the cores 54 is mounted by the magnetic force on the outside of a short-circuiting portion 152*b* of a base 152 which is formed so as to have a locally smaller cross section and on a hammer mounting portion 152*a*. The other structure is the same as that of the embodiment shown in FIG. 2, for example, yoke 156 which is of substantially the same configuration as that of the permanent magnet members 148-1, 148-2, . . . is integrally attracted to the permanent magnet members 148-1, 148-2, . . . .

In the embodiment shown in FIG. 2, the permanent magnet 48 is readily removed from the base 52 by applying the tensile force $\mu P$, if the attracting force between the hammer mounting portion 52*a* and the permanent magnet 48 is P and the friction coefficient which is substantially orthogonal to the direction of magnetization is $\mu$. In the FIG. 3 embodiment, however, the permanent magnet 148 cannot be removed from the base 152 unless external force which is equivalent to the attracting force P, which is larger than $\mu P$, is applied.

That is, in the embodiment shown in FIG. 2, the components of repulsive force of the adjacent permanent magnet members 148 act in the outer peripheral direction of the base 152, in other words, in the direction in which the permanent magnet is removed.

On the other hand, in the FIG. 3 embodiment, the attractive force of the permanent magnet 148 acts in the direction of the side surface of the base 152, namely, in the inner peripheral direction. Accordingly, the components of repulsive force of the adjacent permanent magnet members 148 and the attractive force of the permanent magnet 148 act in the opposite direction, thereby enabling the permanent magnet 148 to be arranged more stably. Consequently, the permanent magnet 148 is not removed by the impact which may be applied to a head when the printer is carried or the like.

Thus, this embodiment is advantageous in that the permanent magnet is not easily peeled off and does not move.

As described above, the printing head of the present invention includes an annular base and a permanent magnet which is attached to the outer periphery of the base. The base is provided with, at the outer portion thereof, a hammer mounting portion for securing a plurality of hammer base portions, at the inner portion thereof, a plurality of implanted columnar cores around which respective coils are wound, and a short-circuiting portion which constitutes closed magnetic circuits of respective coils in cooperation with respective hammers. The permanent magnet is attached to the outside of the short-circuiting portion and the hammer mounting portions at the outer periphery of the base, and the printing head is sub-assembled before the attachment of the permanent magnet. Thus, according to the present invention, assembly, disassembly and the adjustment of magnetic force of a printing head are facilitated, and it is possible to provide a printing head having good printing quality at low cost.

While there has been described what are at present considered to be a preferred embodiments of the invention, it will be understood that various modifications may be made thereto, and it is intended that the appended claims cover all such modifications as fall within the true spirit and scope of the invention.

What is claimed is:

1. A printing head for a dot matrix printer which has a plurality of hammers carrying respective printing wires, a plurality of electromagnets each of which corresponds to one of said plurality of hammers, and a permanent magnet for retaining said hammers at a retracting position thereof, and which is so designed that the magnetic field of said permanent magnet is canceled by exciting said electromagnets so as to release said hammers and drive said printing wires by virtue of the elasticity of said hammers, said printing head comprising:

a annular base having a bottom surface on which a plurality of cores are mounted in ring form, an end portion extending radially of said annular base and forming a hammer disc-mounting portion, and a magnetic path short circuiting portion formed on the sidewall thereof with smaller cross section;

a hammer disc having a plurality of resilient hammers extending toward the center thereof and the outer circumference of which are secured to said hammer disc-mounting portion;

a plurality of printing wires, one end of each of which are fixed on a corresponding one of said plurality of elastic hammers and the other end of each of which form a plurality of printing dots;

a plurality of coils each of which is wound around one of said plurality of cores and which supplies energized magnetic flux to magnetic circuits comprising said annular base and one of each of said plurality of cores and elastic hammers; and a plurality of divided permanent magnet pieces having a sector form and externally attached on the outer circumference of said base by magnetic attractive force thereof corresponding to each of said hammers, said permanent magnet pieces individually giving pre-load attractive force to the hammers, and collectively form a combined magnet ring on the circumference of the base, said permanent magnet pieces are individually attachable and removable to and from the outer circumference of the base in accordance with the magnetic property of each hammer.

2. A printing head for a dot matrix printer according to claim 1, wherein a magnetic by-path portion is formed by a circumference groove formed on the outer circumference of the base, said circumference groove receiving an inner end of said permanent magnet pieces.

3. A printing head for a dot matrix printer according to claim 1, wherein a sector shaped yoke piece is attracted to each of said permanent magnet pieces and collectively form a combined yoke ring on the circumference of the base, said each yoke piece being individually attachable and removable to and from the base to adjust the amount of preload given to the hammer.

4. A printing head for a dot matrix printer according to claim 1, wherein said hammer disc-mounting portion is a flanged-shape form on an end portion of said base protruding radially from an outer circumference thereof and said flanged-shape portion serves to support a hammer disc.

5. A printing head for a dot matrix printer according to claim 4, wherein the upper surfaces of the hammer disc-mounting portion and the core forms a substantially flat surface of a same height.

6. A printing head for a dot matrix printer according to claim 4, wherein said hammer disc includes a hammer base portion formed on the outer circumference thereof and an elastic supporting portion formed in the vicinity of the fixed end of said hammer, said elastic supporting portion having a smaller sectional area.

7. A printing head for a dot matrix printer according to claim 1, wherein a print plate is directly secured to a bottom surface of said base and a conductive line of said coil is coupled to a supplying terminal of said printed circuit board.

8. A printing head for a dot matrix printer according to claim 4, wherein said hammer disc is superposed on the hammer disc-mounting portion of the base, and a spacer and cover are superposed on said hammer disc, and each of said hammer disc, spacer and cover are fixed by a screw on the hammer disc-mounting portion.

* * * * *